US006341654B1

(12) United States Patent
Wilson et al.

(10) Patent No.: US 6,341,654 B1
(45) Date of Patent: Jan. 29, 2002

(54) INFLATABLE PACKER SETTING TOOL ASSEMBLY

(75) Inventors: Paul J. Wilson, Houston, TX (US); James V. Carisella, Harahan, LA (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/292,633

(22) Filed: Apr. 15, 1999

(51) Int. Cl.[7] ..... E21B 33/12

(52) U.S. Cl. ..... 166/387; 166/106; 166/122; 166/187

(58) Field of Search ..... 166/387, 187, 166/181, 182, 106, 120, 122, 123

(56) References Cited

U.S. PATENT DOCUMENTS

| | | | | |
|---|---|---|---|---|
| 3,160,211 A | | 12/1964 | Malone | |
| 3,538,330 A | * | 11/1970 | Youmans | 166/387 |
| 4,064,941 A | | 12/1977 | Smith | 166/300 |
| 4,345,648 A | | 8/1982 | Kuus | 166/106 |
| 4,349,204 A | | 9/1982 | Malone | 277/34 |
| 4,655,292 A | | 4/1987 | Halbardier | 166/187 |
| 4,800,752 A | * | 1/1989 | Piers | 73/155 |
| 4,832,120 A | | 5/1989 | Coronado | 166/187 |
| 4,869,324 A | | 9/1989 | Holder | 166/387 |
| 5,046,557 A | | 9/1991 | Manderscheid | 166/120 |
| 5,320,182 A | | 6/1994 | Mendez | 166/387 |
| 5,404,946 A | * | 4/1995 | Hess | 166/187 |
| 5,417,289 A | | 5/1995 | Carisella | 166/387 |
| 5,469,919 A | | 11/1995 | Carisella | 166/387 |
| 5,495,892 A | | 3/1996 | Carisella | 166/387 |
| 5,564,504 A | | 10/1996 | Carisella | 166/387 |
| 5,582,251 A | | 12/1996 | Bailey et al. | 166/286 |
| 5,718,292 A | | 2/1998 | Heathman et al. | 166/387 |
| 5,813,459 A | | 9/1998 | Carisella | 166/387 |
| 6,209,636 B1 | * | 4/2001 | Roberts et al. | 166/117.6 |

FOREIGN PATENT DOCUMENTS

| | | |
|---|---|---|
| EP | 0290114 | 11/1988 |
| EP | 0722037 A2 | 7/1996 |
| WO | WO9119882 | 12/1991 |
| WO | WO9836152 | 8/1998 |

OTHER PUBLICATIONS

Article entitled, "Proven Elastomer Compound for Extremely Hostile Geothermal and Oil Field Environments", by Hirasuna, et al., IADC/SPE 11407; 1983 Drilling Conference; Feb. 1983.

Article entitled, "Design and Testing of a High–Performance Inflatable Packer", by Eslinger, et al., SPE 37483; 1997 Production Operations Symposium; Mar. 1997.

* cited by examiner

*Primary Examiner*—David Bagnell
*Assistant Examiner*—Zakiya Walker
(74) *Attorney, Agent, or Firm*—Fulbright & Jaworski L.L.P

(57) ABSTRACT

An inflatable packer setting tool assembly is lowerable into a subterranean well bore and operable to set an inflatable packer therein. The tool assembly includes a fluid supply housing and a setting tool that is releasably interconnected to an inflatable packer. The setting tool further includes a pump that is fluidly interconnected with the inflatable packer and is operable to inflate the inflatable packer. The fluid supply housing is fluidly interconnected with the setting tool and includes an inflation fluid passageway that has an inlet and outlet which is fluidly interconnected with a suction side of the pump. The inlet is in the form of an aperture on an outer wall of the supply housing and functions to fluidly interconnect the passageway to a source of first inflation fluid present in the well bore when the setting tool assembly is lowered into the well bore. Further, a filter housing is situated in the supply housing so that the second inflation fluid must pass through the filter housing prior to passing through the inflation fluid passageway. The supply housing also includes a reservoir for containing a second inflation fluid, such as a water-soluble oil. The reservoir includes a spring-loaded movable piston that allows for the volume in the reservoir to vary (e.g., due to thermal expansion of the second inflation fluid). An outlet of the reservoir is fluidly interconnected with the inflation fluid passageway. Thus, the setting tool (i.e., the pump) is operable to draw first and second inflation fluids from the supply housing and to deliver a mixture of the first and second inflation fluids to the inflatable packer so as to inflate inflatable packer.

45 Claims, 6 Drawing Sheets

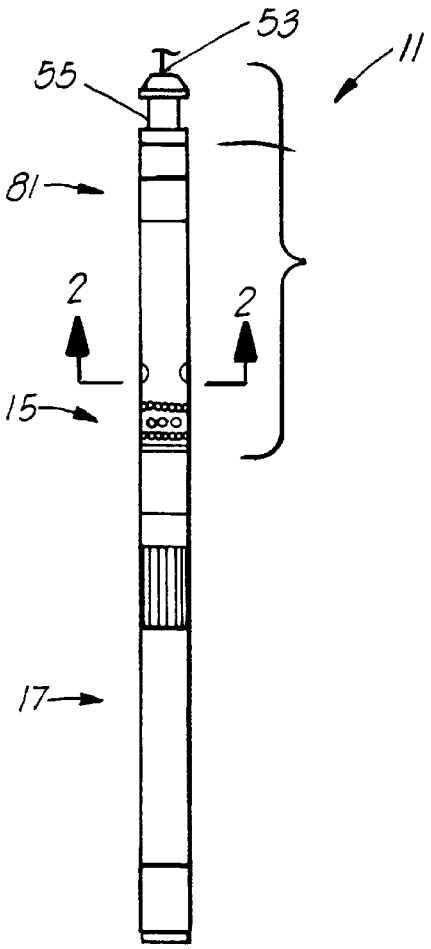
FIG. 1
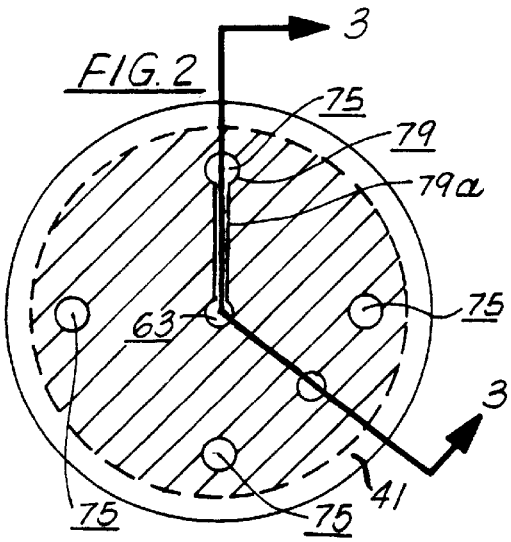
FIG. 2
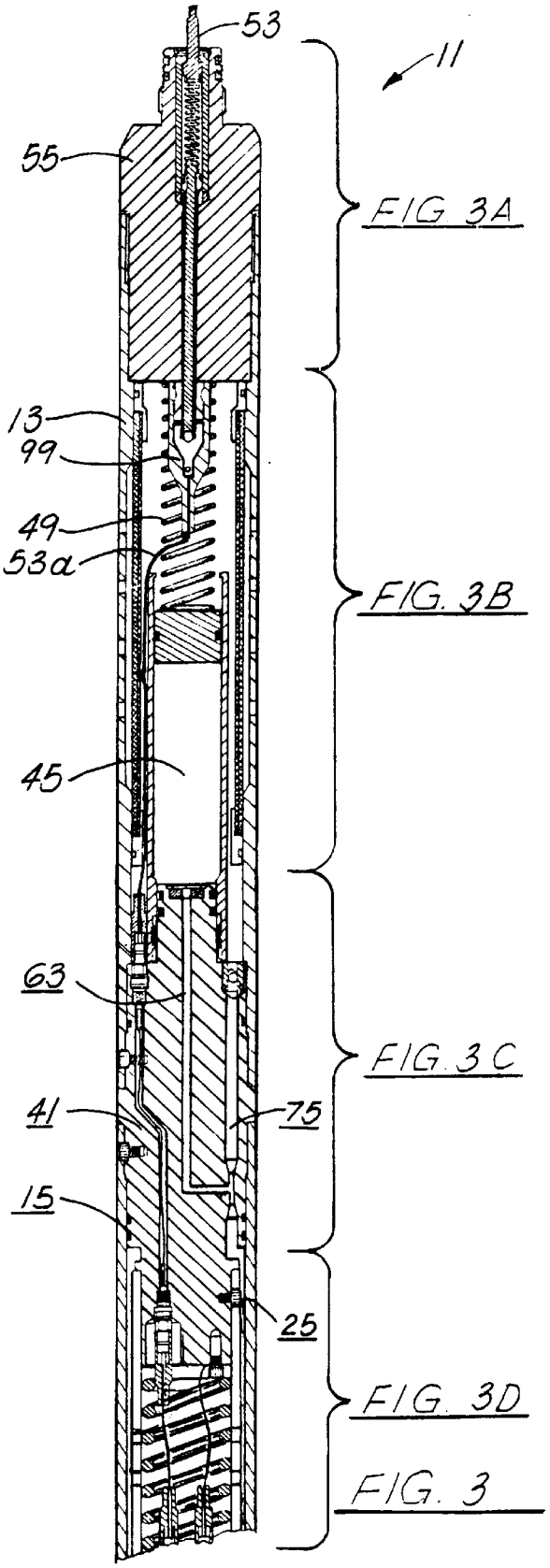

INFLATABLE PACKER SETTING TOOL ASSEMBLY

BACKGROUND OF THE INVENTION

The present invention relates generally to a method of mixing fluids in a well bore so that the resultant mixture may be used to effectuate a change in a downhole tool. Specifically, the method of the present invention relates to setting an inflatable packing device or packer at a location in a well bore, and an apparatus or assembly usable for performing the method.

Many downhole devices are actuated or operated in response to the application of pressurized fluid. Examples of these devices include hydraulically set packers and liner hangers, hydraulic stage cementing collars, pressure actuated perforating gun firing heads, and inflatable packers. In all of these devices, the application of pressurized fluid, to the device, effectuates a change in the device. Hydraulically set packers and liner hangers deploy slips and packing elements in response to the proper application of pressurized fluid. Stage cementing collars shift internally so as to communicate the internal diameter of well bore casing with the outer diameter of that casing. Perforating gun firing heads initiate detonation in the gun in response to the application of fluid pressure. The common element in all of these types of devices is that when pressurized fluid is communicated to the device, that communication effectuates a utilitarian change to the device. Inflatable packing devices such as packers, plugs, bridge plugs, and the like are commonly utilized in the operation or maintenance of subterranean wells. These inflatable packing devices normally comprise an inflatable elastomeric bladder concentrically disposed around a central body portion such as a tube or mandrel. Typically, a sheath of reinforcing slats or ribs is concentrically disposed around the bladder and a thick-walled elastomeric packing cover is concentrically disposed around at least a central portion of the sheath. Such inflatable packing devices may be deployed in a well bore by using tubing or a downhole electric wireline to support the device and to lower the device to a location in the well bore. Typically the inflatable packing device is connected to the electric wire line or tubing at the bottom of a downhole pump device. An assembly of these components is lowered into the well bore at a location below the extent of the production tubing.

Pressurized fluid may be pumped to the inflatable packing device from the top of the well through a pumping line. Alternatively, the inflation fluid (e.g., fresh water) may be transported to the vicinity of the inflatable packing device and then pumped into the inflatable packer. After the inflatable packing device is sufficiently inflated to seal the well bore, it is released from the electric wireline or tubing, and the electric wireline or tubing is retrieved from the well bore

SUMMARY OF THE INVENTION

Among several objects of the invention, a general object of the invention is to provide an improved downhole apparatus for inflating and/or setting an inflatable packing device or packer in a well bore. It is another general object of the invention to provide an improved method of inflating and/or setting an inflatable packer in a well bore. It is yet another general object of the invention to provide a fluid supply housing adapted for use with existing downhole equipment and/or installations.

An inflatable packer setting tool assembly, according to the invention, is lowerable into a subterranean well bore and operable to set an inflatable packer therein. The tool assembly includes an inflatable packer setting tool and a fluid supply housing. The setting tool is releasably interconnected to an inflatable packer, and includes a pump that is fluidly interconnected with the inflatable packer and operable to inflate the inflatable packer. The setting tool may be one of variety of setting tools commercially available in the industry. In one aspect of the invention, at least one fluid supply housing is provided that is adaptable or retrofittable onto such a variety of existing setting tools.

The fluid supply housing is interconnected with the setting tool and includes an inflation fluid passageway that has an inlet and an outlet that is fluidly interconnected with a suction side of the pump. The inlet is fluidly interconnected to a source of first inflation fluid present in the well bore when the setting tool assembly is lowered into the well bore. The first inflation fluid source may be surrounding well bore fluid or may be a volume of fluid (e.g., bailed fluid) lowered from the surface (e.g., fresh water lowered with the setting tool assembly). Preferably, the supply housing includes a filter housing through which the second inflation fluid must pass prior to passing through the inflation fluid passageway. More preferably, the supply housing has an outer wall which has a fluid inlet (e.g., a plurality of apertures) that fluidly communicates the inflation fluid passageway with the source of the first inflation fluid.

The supply housing also includes a reservoir(s) for containing a second inflation fluid (e.g., a water-soluble oil). Preferably, the reservoir includes a spring-loaded movable piston that allows for the volume of the second inflation fluid in the reservoir to vary (e.g., due to thermal expansion of the second inflation fluid). The reservoir has an outlet that is interconnected with the inflation fluid passageway. Thus, the setting tool (i.e., the pump) is operable to draw first and second inflation fluids from the supply housing and to deliver a mixture of the first and second inflation fluids to the inflatable packer so as to inflate inflatable packer. The fluid passageway may be configured so as to pass or deliver a predetermined concentration of one inflation fluid to a second inflation fluid (e.g., 5 to 1, or 10 to 1). This may be done by sizing certain components accordingly, employing one or more metering orifices, and/or employing a venturi device or other fluid control devices (e.g., a dedicated injection pump).

A fluid supply housing, according to the invention, is retrofittable onto an existing setting tool and/or an existing electrical wireline. In one embodiment, the supply housing includes an adapter that may be fluidly and/or electrically engageable or interconnectible with a setting tool. Further, the supply housing may include a portion of an electrical circuit that extends from an interface between the supply housing and the electrical wire line, to an interface between the supply housing and the setting tool. With this embodiment, the electrical wireline may be used to electrically interconnect or to power the setting tool.

A method of setting an inflatable packing device in a well bore, according the invention, includes first releasably connecting a setting tool with an inflatable packer (i.e., such that a pump of the setting tool is fluidly interconnected with the inflatable packer) and interconnecting a fluid supply housing with the setting tool, to form a setting tool assembly. Preferably, a reservoir of the supply housing is provided with an inflation fluid such as a water-soluble oil. Further, the setting tool assembly may be structurally and electrically interconnected with a downhole electric wire line. The electric wire line may then be used to lower the setting tool assembly into the well bore at a location wherein a second inflation fluid is present, and such that the pump of the setting tool is in fluid communication with the second inflation fluid. The pump is then operated to draw the first and second inflation fluids and to deliver a mixture of the first inflation fluid and the second inflation to the inflatable packer, thereby inflating the inflatable packer. Preferably, the method includes the step of mixing the first inflation fluid and the second inflation fluid to create a predetermined mixture, and wherein the step of operating the pump delivers a volume of the mixture to the packer to inflate the packer therewith. After operating the pump, the inflatable packer may be released from the setting tool and the setting tool and the supply housing may be raised from the well bore.

In one application, the mixture consists of at least five parts well bore fluid (e.g., brine, water, condensate, etc.) to one part water-soluble oil. Alternatively, the mixture may be composed of a first inflation fluid having a relatively high volumetric coefficient of thermal expansion but relatively good lubricity properties, and a second inflation fluid having a relatively low volumetric coefficient of thermal expansion and relatively poor lubricity. The resulting mixture is an improved inflation fluid which promotes efficiency, longer life of components, and reliability.

BRIEF DESCRIPTION OF THE DRAWINGS

FIG. 1 is an elevation view of an inflatable packer setting tool assembly according to the invention.

FIG. 2 is a cross-sectional view along line 2—2 of FIG. 1.

DETAILED DESCRIPTION OF THE DRAWINGS

Figure 3A:
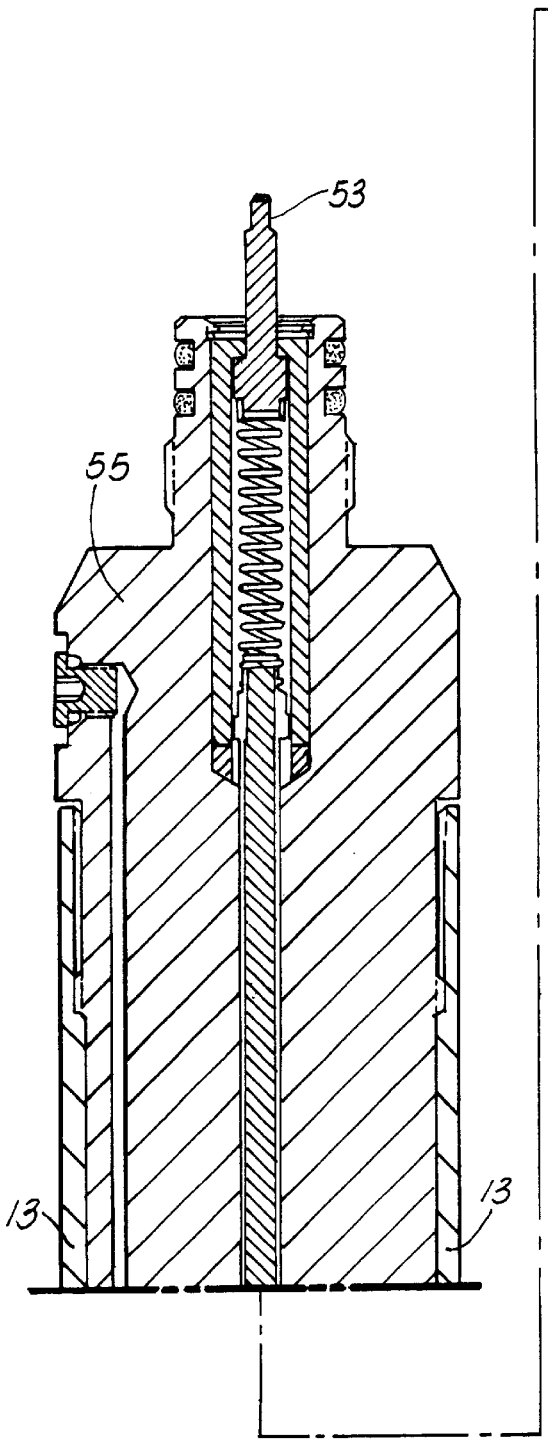
FIGS. 3A–3D are longitudinal sectional views of the inflatable packer setting tool assembly along line 3—3 of FIG. 2.

FIGS. 1–4 depict a downhole apparatus 11 and specific components of the downhole apparatus 11, each embodying the invention. Referring first to the schematic illustration of FIG. 4, the downhole apparatus 11 is an inflatable packer setting tool assembly 11 particularly usable in lowering an inflatable packing device or packer 17 to a location in a well bore, in inflating the inflatable packer 17 with an inflation fluid, and then in setting the inflatable packer 17 therein.

For purposes of description, the tool assembly 11 and components of the tool assembly 11 depicted in the drawings are referred to as having an upper or uphole end and a lower or downhole end. The upper or uphole end is used to refer to the end closest to the surface of a well bore when the tool assembly 11 or the component of the tool assembly 11 is situated in the well bore. The lower or downhole end is used to refer to the end that is opposite the uphole end and farthest from the surface of the well bore.

The tool assembly 11 includes a fluid supply subassembly 81 having a fluid housing 13 connectable at an uphole end, end with a downhole electrical wire line 53. The connection is preferably made using a conventional connectable interface device or wireline connection means 55 and a teardrop boot 99. Thus, the setting tool assembly 11 is adapted for use with existing electrical wireline installations and, more particularly, may be retrofitted onto such existing installations. At a downhole end, the fluid housing 13 is connectable to an inflatable packing setting tool 15. Further, the setting tool 15 is detachably connected to an inflatable packer 17.

It will be understood that the tool assembly 11 of the invention is usable with a variety of conventional inflatable packing devices known in the art including, but not limited to, such devices commonly known as packers, plugs, bridge plugs and the like. Hereinafter, the terms "packer" and "packing device" shall mean any of such packers, plugs, bridge plugs and other inflatable packing devices.

The setting tool 15 depicted in the drawings is a direct drive, electric pump setting tool 15 that is currently available in the marketplace. The setting tool 15 includes a preferably metallic tool housing 31 containing therein, a positive displacement type pump 23 and an electric motor 21 (see e.g., FIG. 4). The tool housing 31 also contains a motor controller and a variety of electrical components hardware and instrumentation. These components are indicated collectively by reference numeral 19 in the schematic of FIG. 4. The electrical components 19 are electrically powered or otherwise communicate with the electrical wire line 53 via a circuitry 53*a* that extends from the electrical wireline 53, through boot 99 and the supply housing 13, and into the tool housing 31.

In an alternative embodiment, the setting tool assembly 11 may be provided with a conventional slickline pump preferably in combination with an intensifier. Such an assembly is generally known and may be readily incorporated with the present invention by one skilled in the art, upon viewing the Drawings and reading the Description provided herein.

Figure 4:
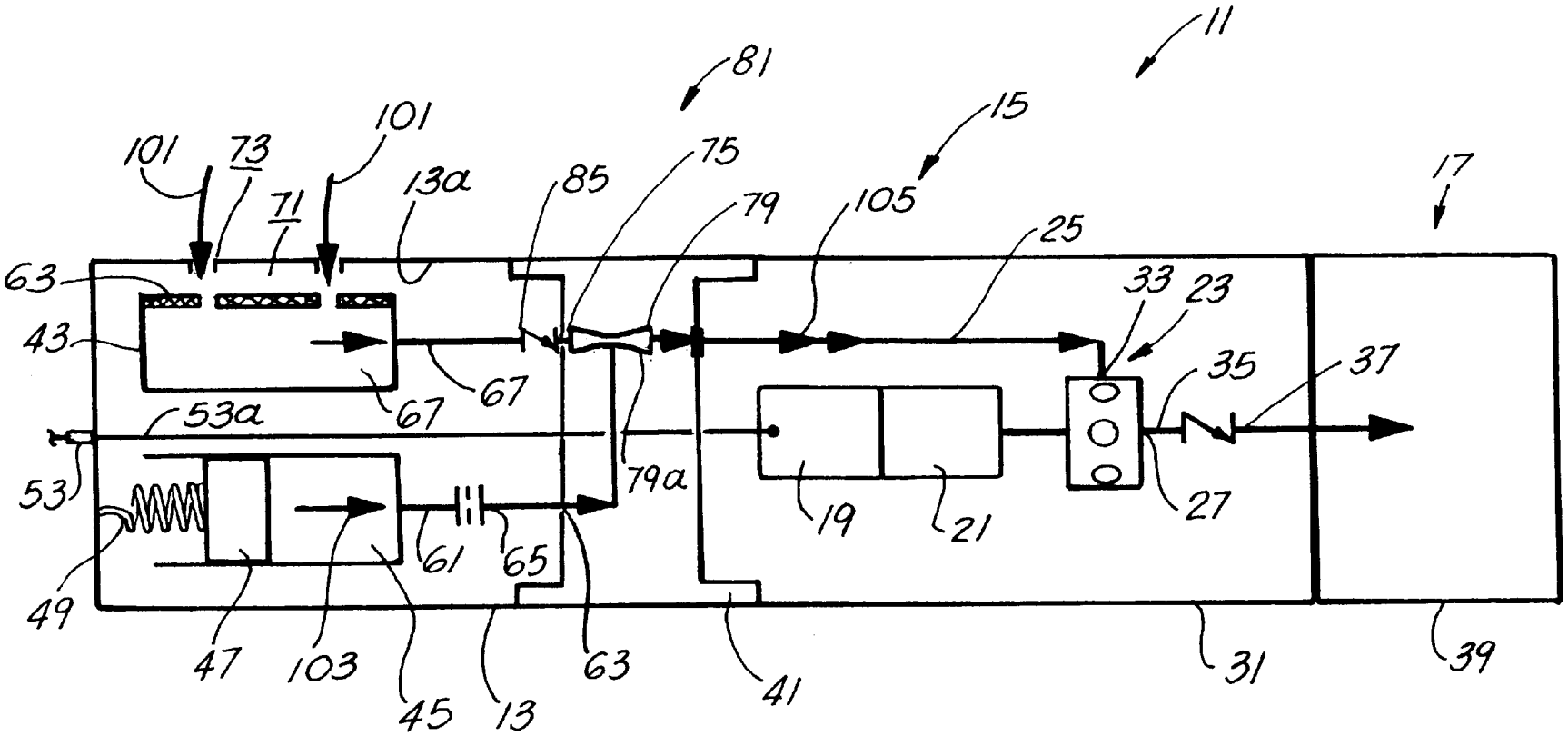
FIG. 4 is a schematic illustration of the inflatable packer setting tool assembly.

Referring to FIG. 4, the pump 23 has a pump suction or inlet 33 preferably equipped with a screen apparatus or filter (not shown) and a pump discharge or outlet 27. An inlet fluid passageway 25 is formed in the tool housing 31 and extends from the uphole end of the tool housing 31 to the pump inlet 33. In some embodiments, the fluid passageway 25 will be formed to provide a tortuous fluid path that is conducive to mixing of fluid flowing therethrough. On the discharge side of the pump 23, a discharge passageway 35 is provided which extends from the pump outlet 27 to the downhole end of the tool housing 31. As shown in FIG. 4, a check valve 37 is preferably installed in the discharge passageway 35 to prevent backflow. The tool housing 31 is detachably attached to a packer housing 39 for the inflatable packer 17, in a manner, whereby the discharge passageway 35 fluidly communicates with the interior of the inflatable packer 17. Further, the connection interface between the inflatable packer 17 and the discharge passageway 35 is provided with a pressure sensitive means (e.g., shear pins) which allows for detaching or release of the tool housing 31 from the packer housing 39 when the inflatable packer 17 is sufficiently inflated to seal the well bore 51 or to otherwise perform its intended function.

Figure 3B:
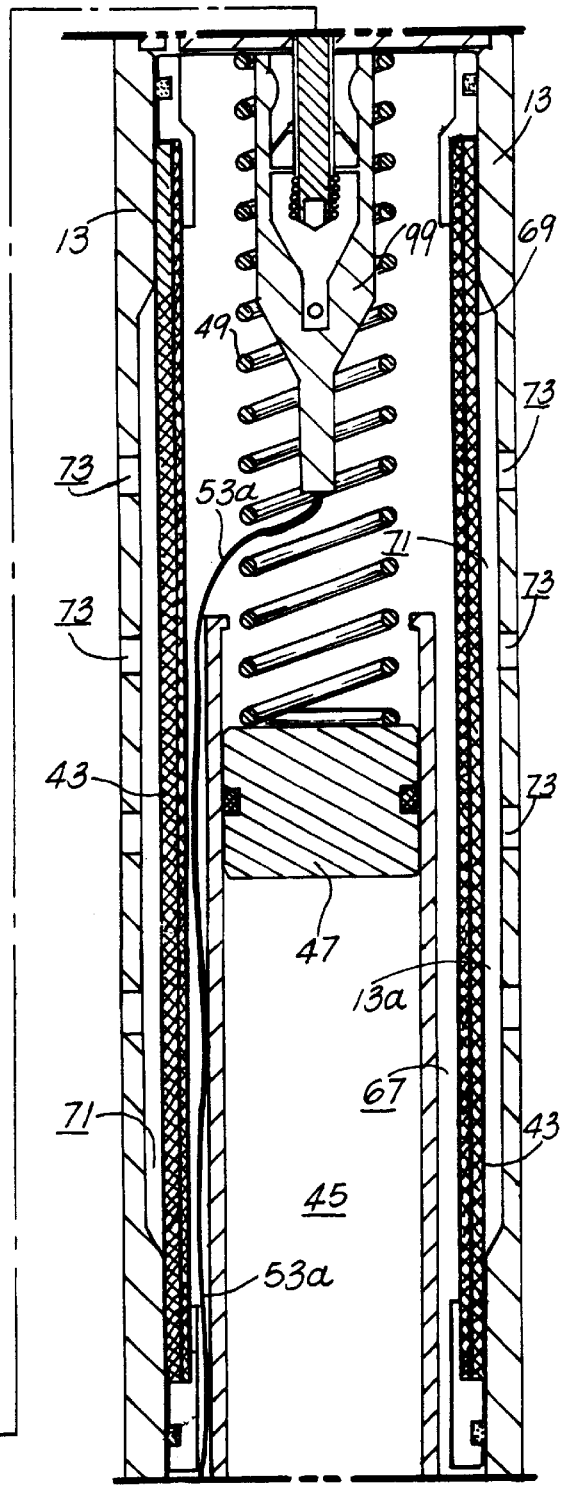

As best shown in FIGS. 3A and 3B, the supply housing 13 of the present invention is structurally and electrically connectable to the electrical wire line 53 using a common adapter or wireline connection device 55. Referring specifically to FIG. 3B, the circuitry 53*a* may be extended or run from the electrical wireline 53 into the supply housing 13. In this way, the supply housing 13 of the present invention may be adapted for use with a variety of existing electrical wireline constructions. It should be noted, however, that the inflatable packer setting tool assembly 11 of the invention may be further adapted for use with other lowering or supporting means such as a tail pipe and tubing string as described in U.S. Pat. No. 5,718,292 (hereby incorporated by reference). The modifications to the tool assembly 11 and, more specifically, to the supply housing 13 to retrofit the inventive supply housing 13 onto such an existing structure will be apparent to one skilled in the art, upon reading the Description and viewing the Drawings.

Figure 3C:
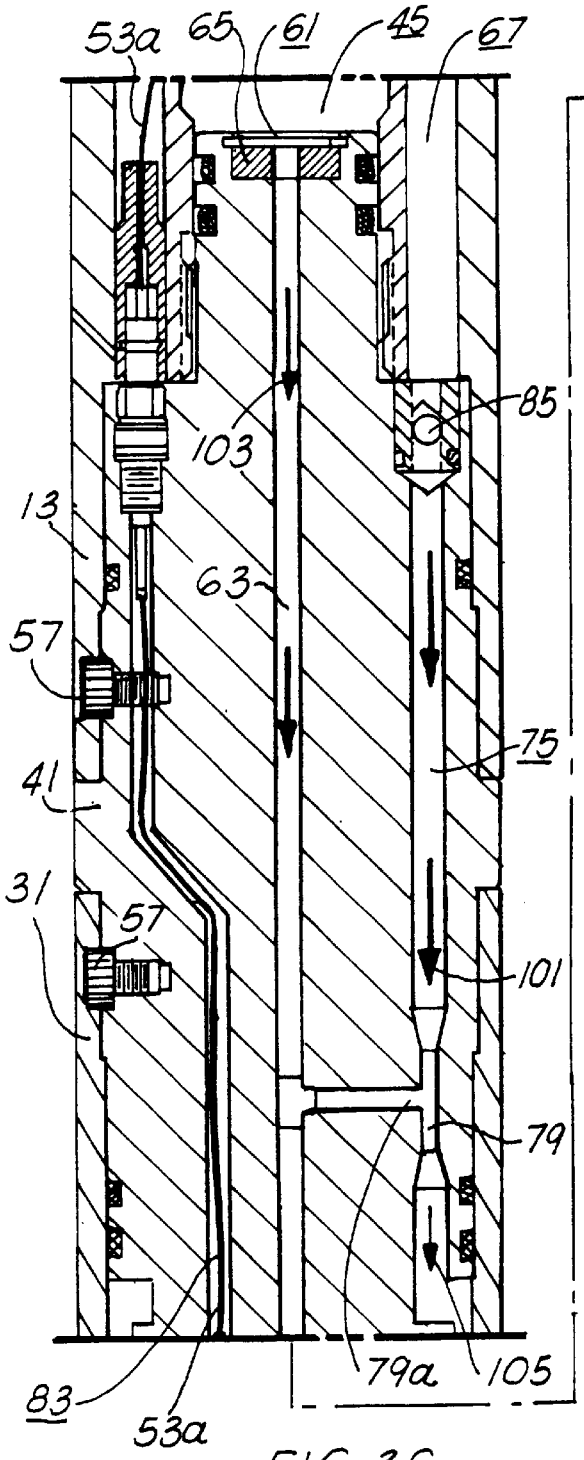
Figure 3D:
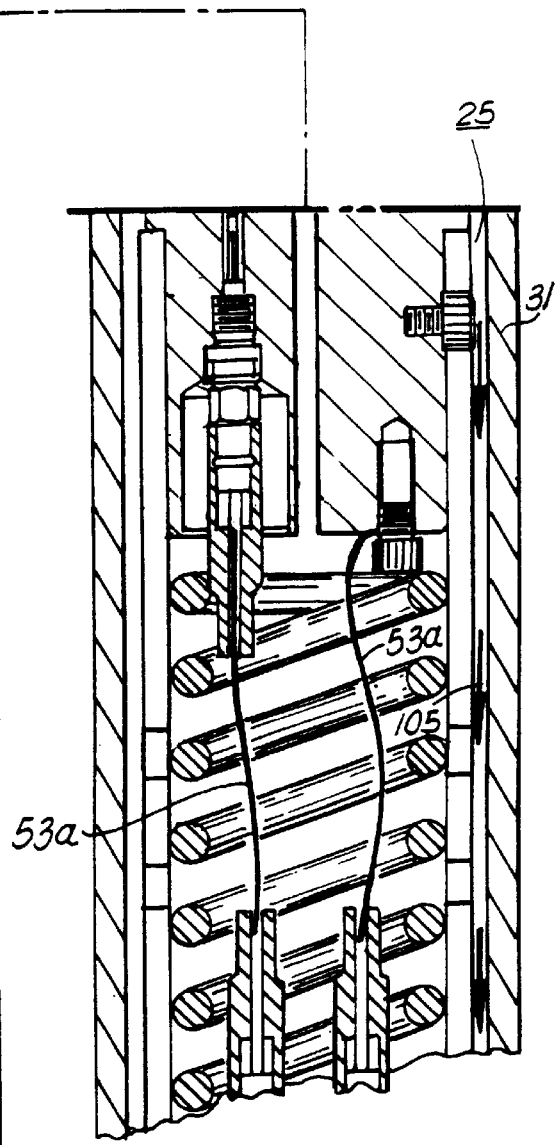

As best shown by FIGS. 3C and 3D, the fluid housing 13 is structurally, electrically and fluidly interconnectible with the tool housing 31 at the downhole end. Structurally, the downhole end of the fluid housing 13 is provided by an adapter 41 that is configured to sealingly engage the uphole end of the tool housing 31 and may be detachably attached thereto via a plurality of set screws 57 (or other conventional fasteners). Further, the circuitry 53*a* is routed through a passageway or electrical conduit 83 which extends from the supply housing 13 into the tool housing 31. Thus, in one aspect of the invention, a supply housing 13 is provided that is retrofittable onto or with an existing conventional tool housing (such as the tool housing 31 depicted in the drawings) and also with an existing electrical wire line (such as the electrical wire line 53 depicted in the drawings). In another aspect of the invention, a supply housing 13 is provided that is structurally, electrically and fluidly adaptable for use with an existing electrical wire line and/or setting tool, and more generally, adaptable with an existing setting tool assembly.

The supply housing 13 is preferably at least one cylindrical metallic housing that contains, among other components, at least one cylindrical reservoir 45 extending substantially the length of the housing 13 and at least one cylindrical filter housing 43 disposed concentrically about and spaced radially outward from cylindrical reservoir 45. The reservoir 45 has an uphole end or opening that is sealed by a movable piston 47. The piston 47 is longitudinally biased by a spring mechanism 49 having a fixed end fixedly attached to the housing 13 and a floating end attached to the piston 47. The downhole end of the reservoir 45 is closed by the adapter 41, save for a reservoir outlet 65 that opens into a longitudinally extending fluid passageway 63. As best shown in FIG. 3C, the fluid passageway 63 is formed centrally through the adapter 41 and includes a conventional metering orifice 65 positioned just downstream of the reservoir outlet 61.

The filter housing 43 extends substantially the length of the reservoir 45 and supports a filter screen 69 having a perforation size specification, at least in one embodiment, of 100 mesh. As a result of the reservoir 45 and filter housing 43 being spaced radially from one other, a circular well bore fluid passage 67 is formed therebetween. Preferably, the filter housing 43 is also spaced radially inward from an inside wall 13*a* of the fluid housing 13, thereby creating a cylindrical fluid well 71 disposed between the filter housing 43 and the fluid housing 13. As best shown in FIG. 3*b*, the inside wall 13 a is equipped with a plurality of apertures or well bore inlets 73 which fluidly communicates with the filter housing 43 via fluid well 71. When the tool assembly 11 is situated in the well bore 51, well bore fluid 101 is allowed to flow from the well bore 51 inwardly through the inlets 73 so as to fill the fluid well 71.

From the fluid well 71, the well bore fluid 101 can pass through the filter screen 69 and into the circular well bore fluid passage 67.

With particular reference to FIGS. 3*b* and 3*c*, the circular well bore fluid passage 67 extends longitudinally toward the adapter 41. The adapter 41 is formed (as necessary) with a plurality of inflation fluid passages 75 which openly communicates with circular well bore passage 67 (see also the cross sectional view of FIG. 2). It should be noted that, in some applications, a single inflation fluid passage may perform adequately. As best shown in FIG. 3*c*, each of the fluid passages 67 or 75 is preferably equipped with a check valve 85. The check valve 85 prevents backflow from the inflation fluid passage 75 into the circular well bore fluid passage 67.

In the embodiment depicted in the drawings, a venturi device 79 is installed in the inflation fluid passage 75 downstream of the check valve 85. The venturi device 79 is positioned such that it has a suction port 79a in fluid communication with the fluid passageway 63 and, thus, may be operated to draw a reservoir fluid 103 from the reservoir 45. More specifically, the pump 23 of the setting tool 15 is operable to draw suction from the inlet passageway 25, which is in fluid communication with the inflation fluid passage 75, and to draw well bore fluid 101 from the well bore fluid passage 67. Upon passing of fluid through the venturi device 79, suction is created at the suction port 79*a* to draw reservoir fluid 103 from the reservoir 45 and to introduce this reservoir fluid 103 into the well bore fluid 101 flow stream. The resulting flow stream consists of a mixture 105 of the well bore fluid 101 and the reservoir fluid. As necessary, a tortuous fluid path may be provided for the inflation fluid passage 75 and/or the pump inlet fluid passageway 25 so as to further promote and enhance mixing between the well bore fluid 101 and the reservoir fluid 103.

It should be noted that, in alternative embodiments, it may not be necessary to provide the inflation fluid passage 75 with a venturi device. The fluid passages 67, 75, 63 and 25 and pump 23 may be sized and configured such that simple "Tee" connection between the fluid passage 63 and fluid passage 75 will be adequate to draw or siphon reservoir fluid flow. Further yet, in alternative embodiments, the connection between fluid passage 63 and fluid passage 75 may be located elsewhere in the supply housing 13 and/or the tool housing 31. Applicants note, however, that the incorporation of the venturi device 79 advantageously promotes the desired fluids mixing and flow through.

In another aspect of the invention, the setting tool assembly 11 is configured 101 and a method is provided to employ an inflation fluid mixture 105 of well bore fluid 101 and reservoir fluid 103 which performs significantly better (in a method of inflating and/or setting an inflatable packer) than prior art fluids (e.g., formation oil, condensate, freshwater) employed as inflation fluids.

In particular, an inflation fluid mixture may be selected that possesses thermal properties which, for example, may be advantageous for inflatable packers used in injection or treating purposes. Furthermore, during production, the hotter temperatures of the well bore fluids in producing the zones below the packer may cause the inflation fluid in the packer to increase in volume, thereby, increasing the potential for ultimate failure (e.g., through rupturing of the packer). In these and other common applications, the setting tool assembly is exposed to a substantial differential in temperature between the time it is initially lowered into the well bore and when, for example, it reaches thermal equilibrium with the well bore environment at the packer location. If the inflation fluid is transported with the setting tool assembly, the capacity of the setting tool assembly must be sufficient to accommodate the resulting volumetric expansion of the inflation fluid. Because some high-performance fluids have a relatively high volumetric coefficient of thermal expansion, the size (e.g., length) of the tool assembly may be very long and present difficulties in handling.

Conversely, if a cooler treating fluid is pumped from the surface at ambient temperature to the location of the setting tool assembly or the packer, the temperature of the packer may be caused to drop significantly. If the reduction of temperature is significant, there is a potential for the oil/condensate in the packer to shrink in volume, thereby reducing the inflation pressure and possibly causing packer failure.

In a method according to the present invention, a clean two-part inflation fluid is provided having improved properties advantageous in the use of inflatable packers. More specifically, an inflation fluid may be provided having a relatively low volumetric coefficient of thermal expansion, while having sufficient lubricity for pumping. In one method of the invention, the reservoir 45 is initially filled with a concentrated water soluble oil ("WS oil"). When the WS oil 103 is mixed with fresh water or formation water, the resulting mixture is an inflation fluid 105 having a lubricity conducive to pumping and having a reduced volumetric coefficient of thermal expansion. In one embodiment, a concentrated WS oil 103 is mixed at a ratio of 1 part WS oil with 10 parts well bore fluid 101. The applicants note that such a reduced volume of reservoir fluid 103 provides the advantageous result of a reservoir having a volume that is reduced by a factor of 10 (over prior art reservoirs). For example, a 10 foot reservoir is adequate in mixing 5 gallons of inflation fluid (typical volume for a 2 ⅛" inflatable packer in 7" casing). It should be further noted that the present invention provides a reservoir 45 that, advantageously, expands in volume as the temperature of the reservoir fluid increases. This feature is made possible by providing a movable piston 47 which can be moved upward against the spring mechanism 49 upon an increase in the pressure inside the reservoir 45 (e.g., due to thermal expansion).

In one method according to the invention, the downhole pump 23 is operated to draw an inflation fluid mixture 105 consisting preferably of about five to fifteen parts of well bore fluid 101 to every part of reservoir fluid 103, and, in some applications, more preferably, about ten parts of well bore fluid 101 to every part of reservoir fluid 103. Of course, the mixture may be adjusted by simply adjusting the metering orifice 65 and/or adjusting the size of the fluid passages 63, 67 and/or the venturi device 79. Alternatively, an injection pump may be provided in fluid communication with the fluid passage 63 and positioned to draw substantially precise amounts of inflation fluid 103 from the reservoir 45. It should also be noted that the well bore fluid 101 is filtered through the filter screen 69 prior to entry into the fluid passages 67 to ensure the quality of the inflation fluid and to further protect the components of the setting tool assembly 11.

Applicants consider water soluble fluids as suitable inflation fluids. It should be noted that the applicants have tested, in a laboratory, the use of water soluble oils, and have found them to be advantageously compatible for use with rubber products at elevated temperature. Applicants have also successfully tested these fluids in a mixture with water for use with a setting pump assembly and an inflatable plug at elevated temperatures.

In particular applicants have found that the inventive inflation fluid is more advantageous than fresh water as an inflatable fluid. Since fresh water has a relatively low volumetric coefficient of thermal expansion, it does not present the difficulties associated with the use of fluids as oil. However, it is also not well suited for pumping because of undesirable lubricity properties. As a result, the use of fresh water as an inflation fluid can decrease the efficiency of the system and shorten the expected life of the pump. Applicants have also found that the inventive inflation fluid is an improvement over straight well bore fluids (e.g., fluids containing brine, condensate, acids, oil, sand, completion fluids).

Figures 5A, 5B, 5C, 5D:
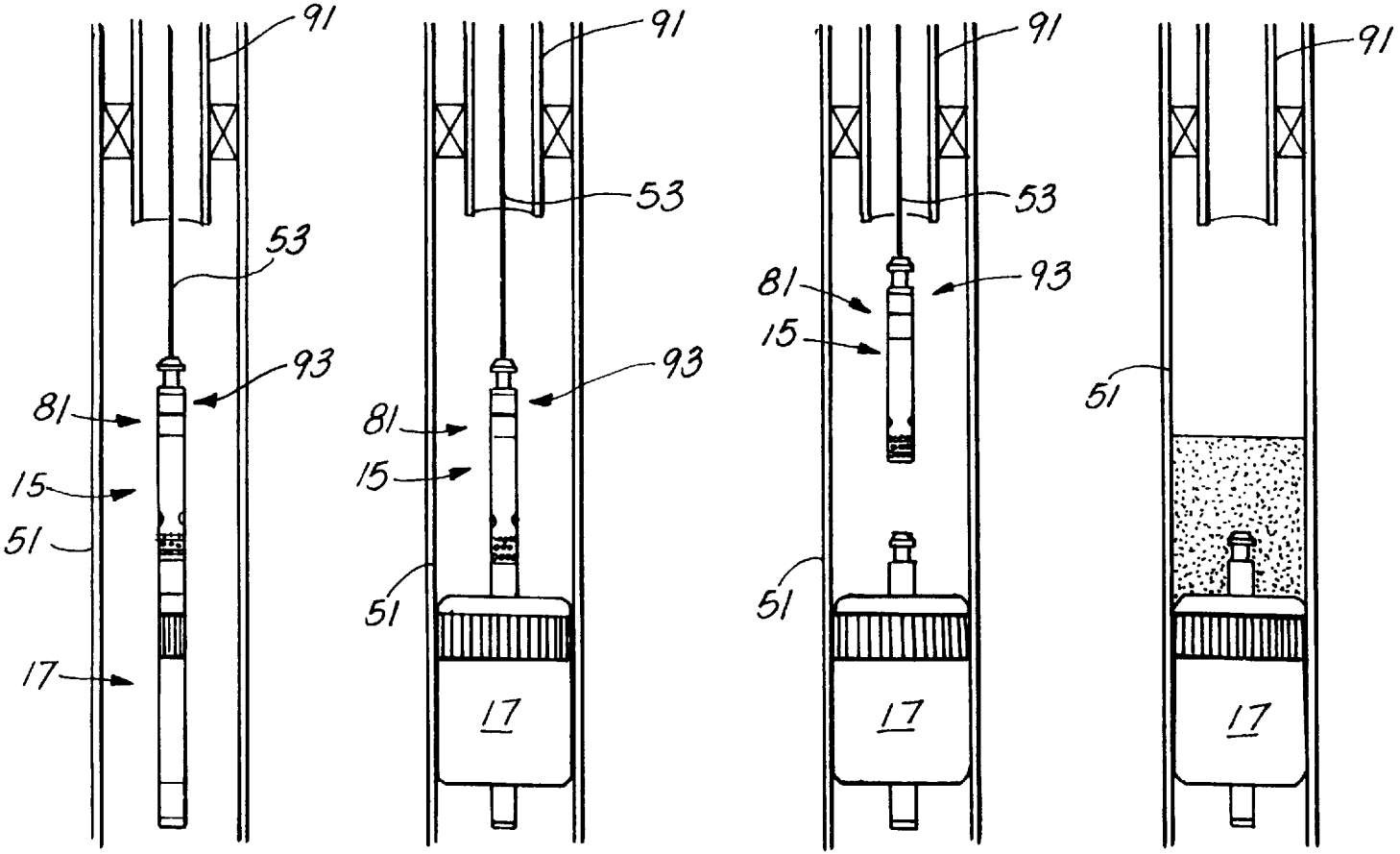
FIGS. 5A–5D are elevation view of a well bore illustrating a method of setting in inflatable packer using the inflatable packer setting tool assembly.

To further clarify the application of the present invention, FIGS. 5A–5D are provided to illustrate a method of locating and setting an inflatable packer 17, according to the invention. The inflatable packer setting tool assembly 11 is connected to an electrical wire line 53 and has a diameter that is less than the well bore 51 and production tubing 91 inside the well bore 51. Prior to entry into the well bore 51, the reservoir 45 of the inflatable packer setting tool assembly 11 is filled with a volume of reservoir fluid 103 such as WS oil. The amount of reservoir fluid 103 is selected in view of the quantity of total fluid required to inflate the inflatable packer 17 and the desired mix ratio, but also taking into account the expected volumetric expansion of the reservoir fluid 103 in response to the elevated temperatures at the target well bore environment. Referring to FIG. 5a, the inflatable packer setting tool assembly 11 is then lowered downward into the well bore 51 using the electrical wire line 53 and, typically, to a location or depth below the production tubing 91. As is known in the field, the tool assembly 11 may be located or positioned accurately in the well bore 51 through use of a depth measurement device incorporated in the tool assembly 11.

After the tool assembly 11 is positioned at the desired depth, the pump 23 is then energized through electrical wire line 53 (see FIG. 5*b*). The operation of the pump 23 draws a pre-determined mixture 105 of the reservoir fluid 103 and the well bore fluid 101, and delivers the mixture 105 into the inflatable packer 17 via the pump discharge passageway 35. Upon adequate inflation of the inflatable packer 17 and attaining a pre-determined pressure, the pump energy operates to release the setting tool 15 from the then-inflated packer 17 (i.e., through a shear pin). Referring to FIG. 5*c*, the setting tool 15 and the fluid housing 81 are then retrieved by raising the electric wireline 53 back to the surface. In some applications, as illustrated in FIG. 5D, the section of the well bore 51 below the inflated packer 17 is sealed by pouring a cement or other hard-drying material layer 95 above the inflated packer 17.

Figure 6:
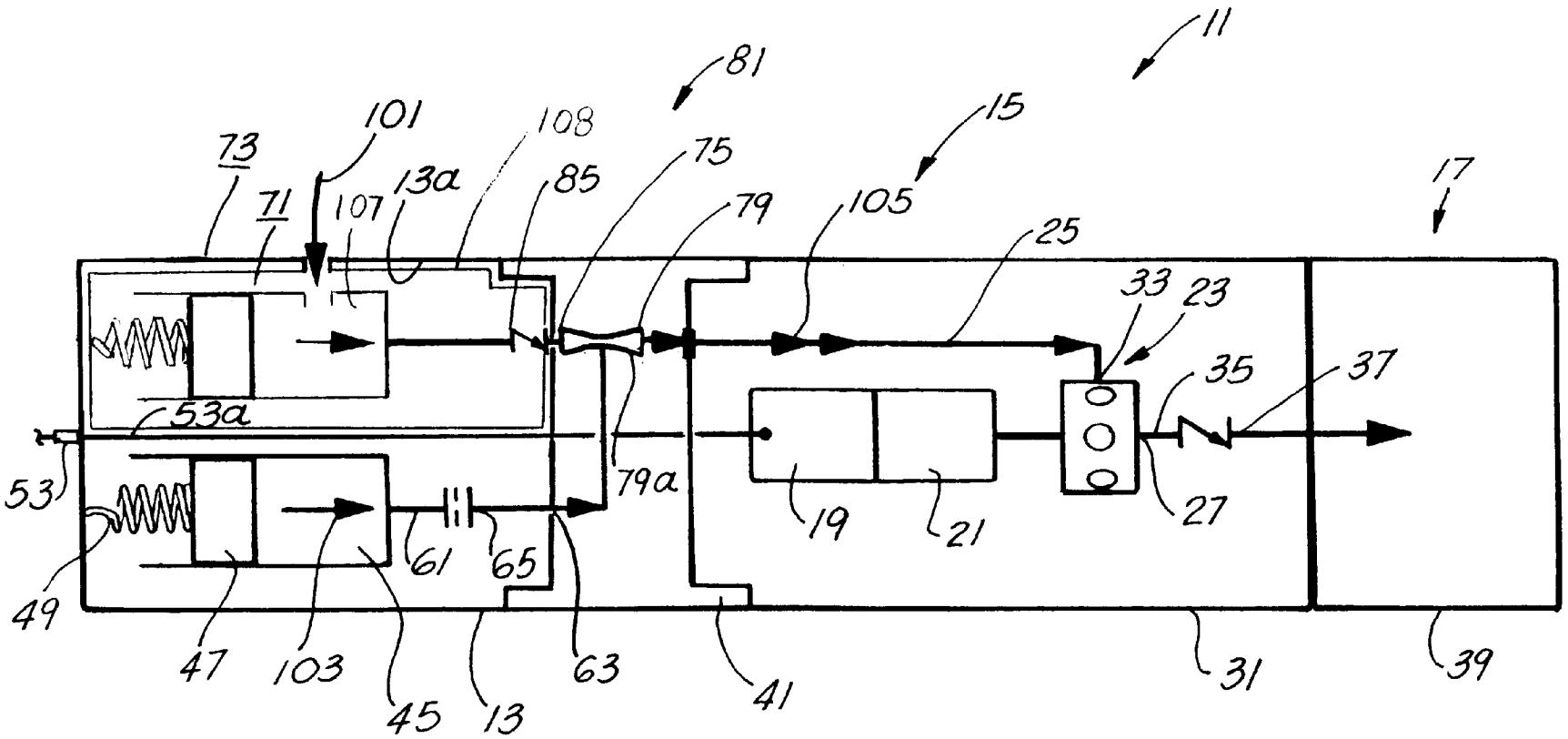
FIG. 6 is a schematic illustration of an alternate embodiment of the inflatable packer setting tool assembly.

In an alternative embodiment of the present invention, a second fluid supply housing or second reservoir may be provided to supply an inflation fluid (see e.g., FIG. 6), such as fresh water in addition to a reservoir 45 of WS oil 103. This inflation fluid, i.e., fresh water, may be provided in a second reservoir 107 of the fluid supply housing 81, or in a separate fluid supply housing 108. The second reservoir or housing may be lowered into the well bore from the surface, but may not be mixed with the WS oil until initiation of the inflation and setting method. This is particularly desirable when one inflation fluid acts as a catalyst when mixed with the other inflation fluid, and the resulting reaction is not useful until inflation and setting of the packer.

Although the embodiment depicted and described herein primarily relates to the use of the inventive inflatable packer setting tool assembly with an electrical wire line and a conventional inflatable packer, the invention is also adapted for use with other common downhole equipment in similar methods of setting and/or inflating inflatable packers. Such applications and, thus alternative methods of the invention, will be apparent to those skilled in the art, upon viewing the drawings and reading the description which are provided herein The foregoing description of the present invention has been presented for purposes of illustration and description.

The description is not intended to limit the invention to the form disclosed herein. Consequently, variations and modifications commensurate with the above teachings, and the skill or knowledge of the relevant art, are within the scope of the invention. The embodiments described herein are further intended to explain the best modes known for practicing the invention and to enable others skilled in the art to utilize the invention in such, or other, embodiments and with various modifications required by the particular applications or uses of the present invention. It is intended that the appended claims be construed to include alternative embodiments to the extent that is permitted by the prior art.

What is claimed is:

1. A method of effectuating a change in a downhole tool comprising:

selecting an inflation fluid from the group of fluids consisting of: water soluble oil, fluids having a thermal coefficient of volumetric expansion substantially greater than that of fluid from the wellbore, fluids characterized as having lubricating properties substantially distinct from the lubricity properties characterized of fluid in the wellbore, and combinations thereof;

providing with the downhole tool, and in association therewith, a fluid reservoir holding the inflation fluid;

placing the downhole tool within a well bore;

combining fluid from the well bore with inflation fluid from the fluid reservoir; and administering the resultant fluid combination to the downhole tool to effectuate a change in the downhole tool.

2. An inflatable packer setting tool for inflating an inflatable packer, comprising:

a chamber;

conduit means for conveying a first fluid to the chamber from a source exterior of the setting tool;

a reservoir for containing a second fluid, the reservoir being disposed in communication with the chamber, wherein the second fluid is a water soluble-oil; and means for conveying a combination of the first fluid and the second fluid from the chamber to inflate the inflatable packer.

3. A method of inflating an inflatable packer comprising:

placing an inflatable packer, having a fluid reservoir in association therewith, in a well bore;

combining a first fluid from the fluid reservoir with a second fluid from a source exterior of the reservoir, wherein the second fluid is a water-soluble oil;

conveying the combined fluids to the inflatable packer to inflate the inflatable packer.

4. An inflatable packer setting tool assembly that is operable to set an inflatable packer, said setting tool assembly comprising:

an inflatable packer setting tool associated with an inflatable packer, said setting tool including a pump operable to inflate the inflatable packer;

a fluid supply housing associated with the setting tool and including an inflation fluid passageway;

means for communicating a first fluid from a first fluid source exterior of the setting tool assembly to the inflation fluid passageway;

a reservoir for containing a second fluid, wherein the second fluid is a water soluble-oil; and means for communicating the second fluid from the reservoir to said inflation fluid passageway.

5. An inflatable packer setting tool assembly that is lowerable into a subterranean well bore and operable to set an inflatable packer therein, said tool assembly comprising:

an inflatable packer setting tool releasably interconnected to an inflatable packer, said setting tool including a pump operable to inflate the inflatable packer;

a fluid supply housing interconnected with the setting tool and including an inflation fluid passageway having an inlet and an outlet, said inlet being fluidly interconnectible to a source of first inflation fluid present in the well bore adjacent the supply housing when the setting tool assembly is lowered into the well bore and said outlet being fluidly interconnected with said pump; and a reservoir for containing a second inflation fluid, said reservoir having an outlet that is fluidly interconnected with said inflation fluid passageway; and wherein said pump has a pump suction that is fluidly interconnected with said inflation fluid passageway of said fluid supply housing and a pump outlet that is fluidly interconnected with said inflatable packer, such that said setting tool is operable to draw first and second inflation fluids to deliver a mixture of said first and second inflation fluids to said inflatable packer to inflate said inflatable packer.

6. The tool assembly of claim 5, further comprising a filter housing positioned such that the first inflation fluid must pass through said filter housing prior to passing into said inflation fluid passageway.

7. The tool assembly of claim 6, wherein said supply housing includes said filter housing.

8. The tool assembly of claim 5, wherein said supply housing includes an outer wall and an inlet through said outer wall that fluidly communicates said inflation fluid passageway with said source of first inflation fluid when said tool assembly is lowered into the well bore.

9. The tool assembly of claim 5, wherein said second inflation fluid is a water soluble oil.

10. The tool assembly of claim 5, wherein said supply housing is retrofitted onto the setting tool.

11. The tool assembly of claim 5, wherein said supply housing includes an adapter fluidly interconnected with said setting tool.

12. The tool assembly of claim 11, wherein said adapter is electrically interconnected with said setting tool.

13. The tool assembly of claim 5, wherein said reservoir includes a spring-loaded piston movable to vary the volume within said reservoir.

14. The tool assembly of claim 5, wherein said tool assembly is interconnected to an electrical wire line, said tool assembly further comprising an electrical circuit extending from said electrical wire line to said setting tool.

15. The tool assembly of claim 5, wherein said supply housing includes a portion of an electrical circuit extending from an uphole end of said supply housing to an interface between said fluid housing and said setting tool.

16. The tool assembly of claim 5, further comprising a second reservoir for supplying the first inflation fluid.

17. A method of setting an inflatable packer in a well bore, said setting method comprising the steps of:

providing an inflatable well bore packer setting tool having a pump;

releasably connecting an inflatable packer with the setting tool such that said pump is fluidly interconnected with the inflatable packer;

providing a fluid supply housing that includes a reservoir containing a first inflation fluid;

connecting the fluid supply housing with the packer setting tool to form a setting tool assembly, whereby the pump is positioned in fluid communication with the supply housing;

lowering the setting tool assembly into the well bore at a location wherein a source of a second inflation fluid is present and whereby the pump is positioned in fluid communication with the source of second inflation fluid; and operating the pump to draw first and second inflation fluids and to deliver a mixture of the first inflation fluid and the second inflation to the inflatable packer, thereby inflating the inflatable packer.

18. The method of claim 17, further comprising the steps of:

releasing the inflatable packer from the setting tool after the step of operating the pump; and raising the setting tool assembly from the well bore.

19. The method of claim 18, wherein the step of operating the pump includes drawing at least a portion of the first inflation fluid from the reservoir through the supply housing.

20. The method of claim 18, wherein the step of providing a supply housing includes providing a supply housing having a filter housing therein, and wherein the step of operating the pump includes drawing at least a portion of the second inflation fluid and passing the at least a portion of the second inflation fluid through the filter housing.

21. The method of claim 17, further comprising the step of mixing the first inflation fluid with the second inflation fluid to create the mixture, and wherein the step of operating the pump delivers a volume of the mixture to the inflatable packer.

22. The method of claim 17, wherein the mixing step includes mixing the first inflation fluid with the second inflation fluid, whereby the concentration of one of the first and second inflation fluids is at least about five times the concentration of the other of the first and second inflation fluids.

23. The method of claim 17, wherein the mixing step includes mixing the first inflation fluid with the second inflation fluid, whereby the concentration of one of the first and second inflation fluid is about ten times the concentration of the other of the first and second inflation fluids.

24. The method of claim 17, further comprising the step of selecting a water-soluble oil as one of the first and second inflation fluids.

25. The method of claim 17, further comprising the step of selecting an inflation fluid for one of the first and second inflation fluids that is characterized by a thermal coefficient of volumetric expansion that is substantially greater than the thermal coefficient of volumetric expansion of the other of the first and second inflation fluids.

26. The method of claim 17, further comprising the step of selecting an inflation fluid for one of the first and second inflation fluids that is characterized as having lubricity properties which are substantially distinct from the lubricity properties of the other of the first and second inflation fluids.

27. The method of claim 17, further comprising the step of interconnecting the supply housing with an electrical wire line and wherein the lowering step includes using the electrical wire line to lower the setting tool assembly.

28. The method of claim 17, wherein the step of interconnecting the supply housing with the electrical wire line electrically interconnects the electrical wireline with the setting tool.

29. The method of claim 17, further comprising steps of:

providing a second fluid supply housing having a second reservoir for delivering the source of second inflation fluid; and lowering the second fluid supply housing with the setting tool assembly.

30. A fluid supply housing fluidly interconnected with a downhole setting tool having a pump for inflating and setting an inflatable packer in a well bore using an inflation fluid, said supply housing comprising:

an inlet for a first inflation fluid;

a reservoir containing a second inflation fluid;

an inflation fluid passageway fluidly communicating with each of said inlet and said reservoir; and a connection interface for connecting said supply housing to the setting tool, such that said inflation fluid passageway is fluidly interconnected with the pump and the pump is operable to draw first and second inflation fluids from said supply housing.

31. The supply housing of claim 30, further comprising a filter housing positioned such that first inflation fluid must pass through said filter housing prior to passing into said inflation fluid passageway.

32. The supply housing of claim 30, wherein said second inflation fluid is a water soluble oil.

33. The supply housing of claim 32, wherein the first inflation fluid is well bore fluid passable from the well bore through said inlet and into said supply housing.

34. The supply housing of claim 30, wherein said reservoir includes a spring-loaded piston movable to vary the volume within said reservoir.

35. The supply housing of claim 30, wherein said supply housing includes a portion of an electrical circuit extending from a second connection interface electrically interconnectible with an electrical wire line, to the first connection interface to electrically interconnect with a setting tool.

36. The supply housing of claim 30, wherein said inflation fluid passageway is configured to pass a predetermined concentration of first inflation fluid to second inflation fluid.

37. The supply housing of claim 30, wherein the first inflation fluid is contained in a second fluid supply housing, said inlet being configured to fluidly communicate with the second fluid supply housing.

38. A method of inflating an inflatable packing device inside a well bore, said inflating method comprising the steps of:

providing a setting tool assembly that includes, a deflated inflatable packer;

an inflatable packer setting tool releasably connected to the inflatable packer and including a pump in fluid communication with the inflatable packer and with a source of well bore fluid in the area adjacent the setting tool assembly;

a reservoir containing a reservoir fluid, the reservoir being in fluid communication with the pump; and operating the pump to draw well bore fluid and reservoir fluid so as to deliver a mixture of the well bore fluid and the reservoir fluid to the inflatable packer, thereby inflating the inflatable packer.

39. The method of claim 38, further comprising the step of releasing the inflatable packer from the setting tool after the step of operating the pump.

40. The method of claim 38, further comprising the step of mixing the well bore fluid and the reservoir fluid to create the mixture, and wherein the step of operating the pump delivers a volume of the mixture to the inflatable packer.

41. The method of claim 40, further comprising the step of mixing the well bore fluid and the reservoir fluid in concentrations of at least about five parts well bore fluid to one part reservoir fluid.

42. The method of claim 38, further comprising the step of selecting a water-soluble oil as the reservoir fluid.

43. The method of claim 38, further comprising the step of selecting a reservoir fluid having lubricity properties that are substantially distinct from the lubricity properties of the well bore fluid.

44. The method of claim 43, further comprising the step of selecting a reservoir fluid having a volumetric coefficient of thermal expansion of the second inflation fluid that is substantially greater than the volumetric coefficient of thermal expansion of the well bore fluid.

45. The method of claim 38, further comprising the step of providing a fluid supply housing that includes the reservoir, a filter housing, and a fluid inlet fluidly communicating the filter housing with the source of well bore fluid, and wherein the step of operating the pump includes drawing well bore fluid through the fluid inlet and the filter housing.

* * * * *